US009682748B2

(12) United States Patent
Cesario

(10) Patent No.: US 9,682,748 B2
(45) Date of Patent: Jun. 20, 2017

(54) ANCHORING, MANEUVERING, DOCKING AND STABALIZING APPARATUS FOR WATER VESSEL

(71) Applicant: Lucas Cesario, Cape Coral, FL (US)

(72) Inventor: Lucas Cesario, Cape Coral, FL (US)

(73) Assignee: L&M DESIGNS, INC., Hillsboro Beach, FL (US)

( * ) Notice: Subject to any disclaimer, the term of this patent is extended or adjusted under 35 U.S.C. 154(b) by 0 days.

(21) Appl. No.: 14/220,015

(22) Filed: Mar. 19, 2014

(65) Prior Publication Data

US 2014/0202369 A1 Jul. 24, 2014

Related U.S. Application Data

(63) Continuation-in-part of application No. 13/244,645, filed on Sep. 25, 2011, now abandoned, and a continuation-in-part of application No. 12/244,632, filed on Oct. 2, 2008, now abandoned, and a continuation-in-part of application No. 13/937,189, filed on Jul. 8, 2013, now abandoned.

(51) Int. Cl.

| | |
|---|---|
| ***B63B 35/85*** | (2006.01) |
| ***B63B 21/26*** | (2006.01) |
| ***B63B 21/30*** | (2006.01) |
| *B63B 35/71* | (2006.01) |

(52) U.S. Cl.

CPC ..... *B63B 21/26* (2013.01); *B63B 21/30* (2013.01); *B63B 35/85* (2013.01); *B63B 2035/715* (2013.01); *B63B 2221/20* (2013.01)

(58) Field of Classification Search

CPC ..... B63B 21/26; B63B 21/22

See application file for complete search history.

(56) References Cited

U.S. PATENT DOCUMENTS

| | | | | |
|---|---|---|---|---|
| 3,377,977 | A * | 4/1968 | Elof | B63B 35/7933 440/13 |
| 3,740,780 | A * | 6/1973 | Knipple | B63H 16/04 114/364 |
| 6,092,484 | A | 7/2000 | Babin | |
| 6,220,197 | B1 | 4/2001 | Pohlman | |
| 6,273,016 | B1 | 8/2001 | Gibbs | |
| 6,273,020 | B1 * | 8/2001 | D'Alessandro | B63B 17/00 114/364 |
| 6,890,226 | B2 * | 5/2005 | Wang | B63H 16/04 440/101 |
| 7,270,072 | B2 | 9/2007 | Waldrop | |
| 7,270,073 | B1 | 9/2007 | Waldrop | |
| 7,827,927 | B2 | 11/2010 | Kivi | |
| 7,861,661 | B2 | 1/2011 | Beaty | |
| 8,051,789 | B1 * | 11/2011 | Tylisz | B63B 21/22 114/221 R |

(Continued)

*Primary Examiner* — Edwin Swinehart

(74) *Attorney, Agent, or Firm* — The Concept Law Group, P.A.; Scott D. Smiley; Erin A. Martin

(57) ABSTRACT

The present invention is directed to an apparatus that allows a boat to be anchored, maneuvered, docking, and stabilized. The invention has a member that can rotate about a first axis from a stowed position to an anchored position. Or the member may be placed downwardly in the ground floor of the body of water, for maneuvering the vessel and to move the vessel in a desired direction. The hull of the vessel may have a channel for the rotation or movement of the member within the channel.

16 Claims, 6 Drawing Sheets

(56) References Cited

U.S. PATENT DOCUMENTS 8,104,418 B1 * 1/2012 Thompson ..... B63B 21/22
114/230.16
8,312,832 B1 * 11/2012 Camp ..... B63B 21/26
114/294

* cited by examiner

ANCHORING, MANEUVERING, DOCKING AND STABALIZING APPARATUS FOR WATER VESSEL

RELATED APPLICATIONS

This is a continuation in part patent application claiming priority from patent application Ser. No. 13/244,645 titled ANCHOR AND KEEL APPARATUS, filed on 25 Sep. 2011, Ser. No. 13,244,632 titled ANCHOR AND KEEL APPARATUS FOR CHANELLED HULL filed Sep. 25, 2011, and patent application Ser. No. 13/937,189 titled ANCHORING, MANEUVERING, DOCKING AND STABILIZING APPARATUS FOR WATER VESSEL filed Jul. 8, 2013.

STATEMENT REGARDING FEDERALLY SPONSORED RESEARCH OR DEVELOPMENT

This invention did not receive federally sponsored research or development.

FIELD OF THE INVENTION

This invention relates to an apparatus that can anchor a boat and allow the user to maneuver, dock, and stabilize the boat. Also, this invention can cause the boat to be fixed with respect to the water. The invention allows one to maneuver a vessel in the water, to move the vessel forward or backward, and as a docking means.

BACKGROUND OF THE INVENTION

U.S. Pat. No. 7,861,661 to Beaty discloses an "Anchoring system for a kayak." The abstract provides:

> Apparatus is disclosed for anchoring a kayak to the bottom of a body of shallow water. The apparatus includes first and seconds tubes for attachment to the kayak proximate the upper portion of the kayak between the bow and the stern of the kayak, and first and second shafts which are disposed in the proximate seat which comprises two sets of gearing mechanisms for operative engagement with the two shafts, and a rotatable handle which is external to the gear box for operative connection to the first and second gearing mechanisms. First and second actuation devices external to the gear box are provided which have first and second positions, and, in the first position, the actuation devices function to establish operative connection between the first and second gearing mechanisms and a rotatable handle.

This invention requires a gear box and crank to deploy two tubes with shafts attached to each end. The applicant's invention has a simple, single shaft design which swivels about a fixed axis.

U.S. Pat. No. 7,827,927 to Kivi discloses an "Anchoring system for watercraft vessels." The abstract provides:

> An anchoring system for a watercraft vessel, the anchoring system including an anchor bracket configured to be mountable on the watercraft vessel; a sleeve, the sliding tube being at least partially hollow and having a first end and a second end, a rod having a first end disposed within a sliding tube lumen and a second end having a floor contacting tip; the floor contacting tip operable to penetrate the bottom of a creek, lake, river or ocean flat and a retraction member connected to the rod. The retraction member is configured to retract the rod into the sliding tube and retract the sliding tube through the sleeve.

It is positioned on the front, rather than at hand's reach. The goal of this invention is to provide an anchor that enters the water silently and does not drag or snag on the bottom of the body of water.

U.S. Pat. Nos. 7,270,072 and 7,270,073 to Waldrop discloses a "Florida anchor." The abstract of U.S. Pat. No. 7,270,072 provides:

> An anchor system designed to quickly anchor and release a boat in shallow water with minimal effort and little to no distraction from other activities such as fishing, which has an anchor sleeve containing a sleeve liner through which an anchor pole with a pointed bottom end passes through, said anchor pole extending below the hull of a boat into the lake or river bottom beneath, and which anchor pole can engage a locking insert when the anchor pole is twisted in either direction, said locking insert located in a notch cut out of the top of the sleeve liner, allowing the anchor to be locked in a stowed position, and which has an upper flange which engages a hand grip wrapped around the top of the anchor pole, preventing the top end of the anchor pole from dropping completely through the boat hull, and which has a bottom flange attached to the boat hull bottom through which the anchor pole passes, and which has an attaching nut which attaches the anchor sleeve to the boat deck.

The object of this invention is to provide a quick and easy way for boat operators to anchor their boats. The most specific use is for boats which have a trolling motor. The design is a single shaft which can be deployed into the water and also stowed in a vertical position on the side of the boat, however, this design is vertical at all times.

U.S. Pat. No. 6,092,484 to Babin et al. discloses a "Marine anchor system." The abstract provides:

An improved anchor is provided for small boats for mooring in the bottom of bodies of water such as lakes and coastal and inland waters. Embodiments include an anchor comprising a rod, such as a round cross-section stainless steel rod about 3-6 feet long and about 1-2 inches in diameter. One end of the rod is tapered, either to a point or to a blunt hemispherical end, while the other end has a swivel with an eyelet for connecting a shackle rope or chain. A hand grip is provided on the rod between the two ends of the rod. The tapered end of the rod is inserted into the bottom of a body of water using the hand grip. Thus, the anchor easily sets on the first attempt, the swivel accommodates changes in current and wind conditions that may move the boat while it is moored, thereby avoiding dislodging of the anchor and the anchor does not snag on debris.

Here, the user either grips the pole and inserts it into the water or throws it into the water like a spear. Furthermore, one end is attached to a rope or chain which is fixed to the boat. The design allows the boat to swivel about the fixed end in order to accommodate for changes in current and prevent the anchor from dislodging.

U.S. Pat. No. 6,220,197 to Pohlman discloses an "Anchoring and operating device for a watercraft." The abstract provides:

> A device for operating and anchoring in congested and hazardous water areas is provided with a spud assembly for easy operation. A pole is provided for moving a watercraft in shallow water. The pole functions through an operating cylinder connected to a maneuvering ring. The spud assembly has a locking device for locking the maneuvering ring and the operating cylinder against movement in order to anchor the watercraft with the pole.

This invention utilizes a rod with telescoping sections which can easily be extended for use as an anchor or to walk a boat along hazardous conditions. This invention also stabilizes the boat 280. It can then be retracted and stowed in a vertical position. This invention utilizes a spud assembly to lock the rod into place at the desired length.

Multiple embodiments of the system are disclosed herein. It will be understood that other objects and purposes of the invention, and variations thereof, will be apparent upon reading the following specification and inspecting the accompanying drawings.

SUMMARY OF THE INVENTION

One aspect of the present invention is a an anchoring, maneuvering, and stabilizing apparatus, for a vessel, comprising: a member pivoting means having a base secured to a vessel and having a collar rotatably disposed on said base; a member slidably disposed within said collar; and a member retention means secured to the vessel in alignment with said member pivoting means so that the member may rotate clockwise and counterclockwise within a channel about a first axis oriented substantially vertical and said first axis also oriented substantially vertical with respect to said member.

Another aspect of the present invention an anchoring, maneuvering, and stabilizing apparatus for a vessel, comprising: a member pivoting means having a base secured to a vessel and having a collar rotatably disposed on the base; a member slidably disposed within said collar; a member retention means secured to the side of a vessel in alignment with said member pivoting means so that the member may rotate clockwise and counterclockwise within a channel about a first axis oriented substantially vertical and said first axis also oriented substantially vertical with respect to said member; a lock and lock release to allow the member pivoting means to rotate at selected angles and lock the member pivoting means in place; said member has a member distal end that has a replaceable second end; and said member pivoting means is a ball and socket joint.

These and other features, aspects and advantages of the present invention will become better understood with reference to the following drawings, description and claims.

DETAILED DESCRIPTION OF THE INVENTION

Reference Numerals List

Figure 1:
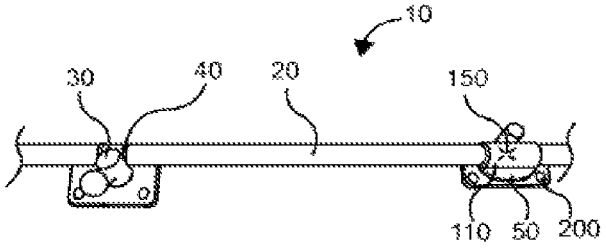
FIG. 1 is a pictorial view of one embodiment of the member of the present invention.

10 anchoring, maneuvering, docking, and stabilizing apparatus
20 member
30 retention means
40 flexible cord and ball system
50 member pivoting means
60 lock and lock release
70 ground penetration means
80 aperture
90 member distal end
100 set screw
110 second end
120 point-shaped end
130 screw shaped end
140 extension
150 first axis
160 channel
170 lock pin apparatus
190 collar
200 base
210 point
220 multiple pronged tip
230 extension
240 wing nut screw ring
250 ball and socket joint
260 back or front of boat pivoting means
270 member holder
280 boat
300 backing plate
310 base swivel
320 retainer swivel
330 washer
340 top member retention means The following detailed description is of the best currently contemplated modes of carrying out the invention. The description is not to be taken in a limiting sense, but is made merely for the purpose of illustrating the general principles of the invention, since the scope of the invention is best defined by the appended claims.

Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words. Also, "connected to," "secured to," or similar language includes the definitions "indirectly connected to," "directly connected to," "indirectly secured to," and "directly secured to."

Figure 4:
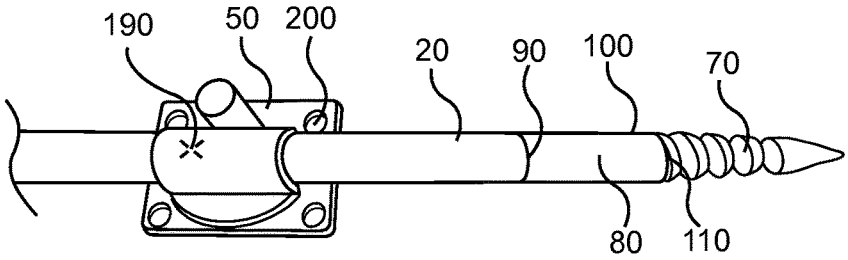
FIG. 4 is a another pictorial view of one embodiment of the present invention showing a ground penetration means.

As seen in FIG. 1, the present invention 10, also called an anchoring, maneuvering, and stabilizing apparatus 10, discloses an anchoring, maneuvering, and stabilizing apparatus 10 for a watercraft, such as a boat 280. The anchoring and maneuvering apparatus 10 may be a single shaft 20, also referred to as a member 20, which may terminate at a second end 110, as best seen in FIG. 4. The second end 110 may have a point-shaped end 120 or a screw-shaped end 130 for the purpose of embedding into the bottom of a body of water.

The anchoring, maneuvering, docking, and stabilizing apparatus 10 may be slidably disposed within a collar 190. The collar 190 that may be integral with a member pivoting means 50 or back-front pivoting means 260 so that the collar 190 can rotate or pivot about a first axis 150. The collar 190 may be rotatably disposed on a base 200 of the member pivoting means 50 or back-front pivoting means.

The member 20, when not in use, may be stowed in a substantially horizontal position using a member retention means 30, such as a flexible cord secured to the hull. The flexible cord can extend over the member 20 and attach to an extension 140 that extends outwardly from the hull or vessel. A ball may be attached to the flexible cord, and this type of member retention means 30 may be called a flexible cord and ball system 40. The member retention means 30 may hold the member 20 in contact with the extension to prevent the member 20 from moving.

The flexible cord and ball system 40 can easily be unwrapped, and the member 10 may then pivot or swivel about a fixed axis 150 for deployment into the water.

FIG. 1 also illustrates an embodiment of the member pivoting means 50 which may be secured to the side of a hull of a water craft. The member pivoting means 50 may rotate about a first axis 150, which may be substantially perpendicular with respect to the member 20, so that the member 20 may rotate about the first axis 150. This way the member 20 can be moved from its stowed position when it is secured to the member retention means 30, to any appropriate angle so that the member 20 can contact the bottom surface of a body of water, such as a lake, for anchoring or stabilizing purposes. The member 20 is also used to maneuver the vessel and to move the vessel forward or backward, and can be used to dock the boat or vessel 280.

The member pivoting means 50 may be able to be secured at a variety of angular positions via a lock and release. In one embodiment, the lock and lock release may comprise a pin that is biasly forced toward the hull, so as to be able to set in a lock pin aperture or several pin apertures to set the member pivoting means 50 at a desired position. For example, from the stowed position, when the member 20 is oriented substantially horizontal, the member pivoting means 50 may be rotated about 90 degrees, so that the member 20 is now oriented substantially vertical so that the second 110 or ground penetration means 70 may be disposed in the ground to anchor the vessel and stabilize the vessel.

Figure 2:
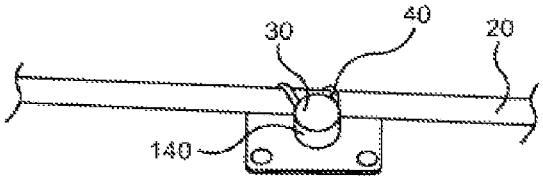
FIG. 2 is another pictorial view of one embodiment of the present invention showing a member retention means.

FIG. 2 illustrates one embodiment of the member retention means 30 of the present invention. The member retention means 30 may be secured to a side of a vessel such that the member 20 can rest upon the member retention means 30 when the member 20 is disposed within a collar 190. The member retention means 30 may have an extension 140 that extends away from the side of the vessel. The member retention means 30 may rest on a top side of the extension 140. The member retention means 30 may have two elastic cables that are connected to the vessel that terminates inside a ball. The elastic cables can then be stretched over the member 20, and the ball can be disposed on the bottom of the extension 140, so that the member 20 is forced downward against the extension 140.

Figure 3:
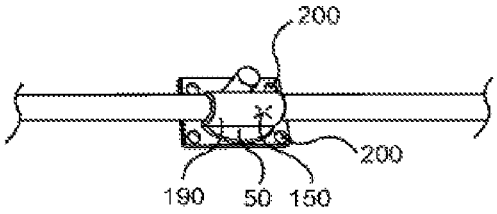
FIG. 3 is another pictorial view of one embodiment of the present invention showing a member pivot means.

FIG. 3 illustrates an embodiment of the member pivoting means 50, which may rotate about a first axis 150. The first axis 150 may extend horizontally away from or through the vessel, to allow the member 20 to be rotated in a clockwise, or counter clockwise direction.

FIG. 3 illustrates an embodiment of the collar 190 of the present invention 10. The member pivoting means 50 may have a base 200 that is secured to the hull of a vessel. A collar 190 may be rotatably disposed on the base 200 so the collar may rotate upon a first axis 150.

Figure 4A:
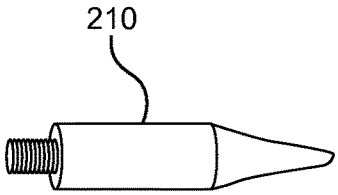
FIG. 4A shows another embodiment of the ground penetration means.
Figure 4B:
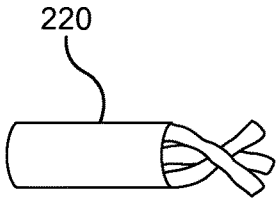
FIG. 4B shows a third embodiment of the ground penetration means.
Figure 4C:
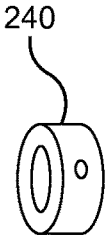
FIG. 4C shows an embodiment of a wing nut screw wing.
Figure 4D:
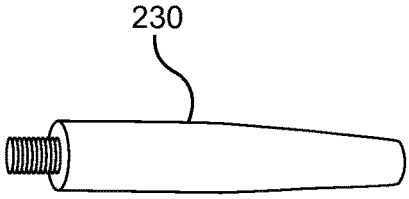
FIG. 4D shows an embodiment of an extension.

FIG. 4 illustrates an embodiment of the second end 110 of the present invention 10. In one embodiment the second end 110 may be replaceable and may have different shaped tips. For example, one tip may have a ground penetrating means 70. Other replaceable tips include a point 210, as in FIG. 4A, a multiple pronged tip 220, as in FIG. 4B, an extension 230, as in FIG. 4D, and a wing nut screw ring 240 as illustrated in FIG. 4C.

FIG. 4 illustrates an embodiment of the present invention 10 having an aperture 80 that may receive a set screw (not illustrated) so secure the second end 110 to the member distal end 90.

Figure 5:
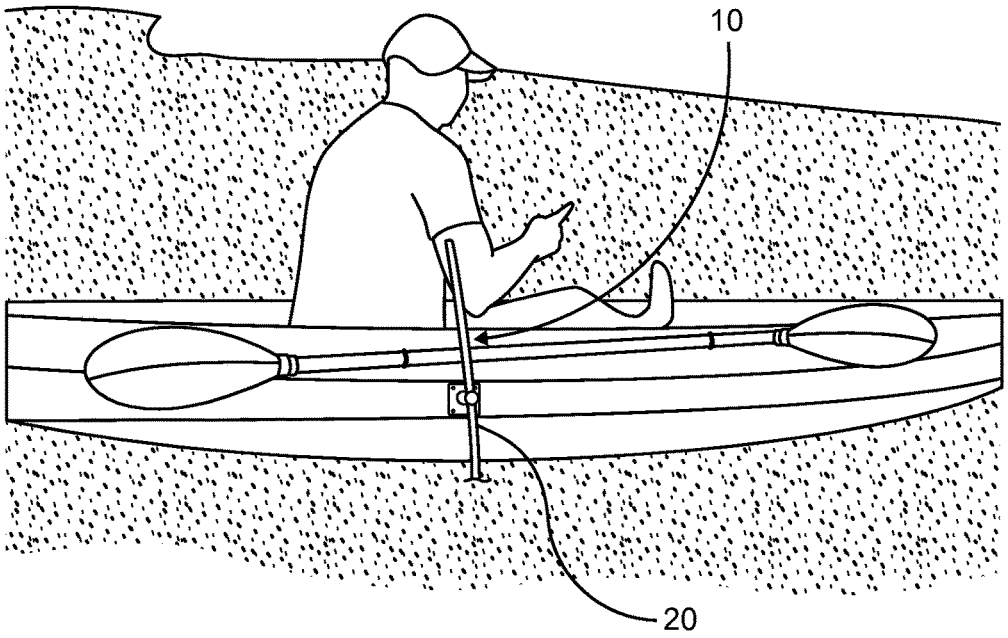
FIG. 5 is another pictorial view of one embodiment of the present invention showing a member anchoring a boat.

FIG. 5 illustrates one embodiment of the present invention 10 where the member 20 is oriented in a substantially vertical position in the water to anchor and/or stabilize the vessel.

Figure 6:
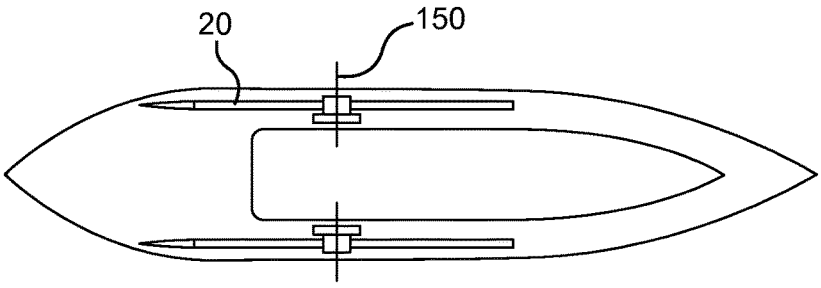
FIG. 6 is another pictorial top view of another embodiment of the present invention.
Figure 7:
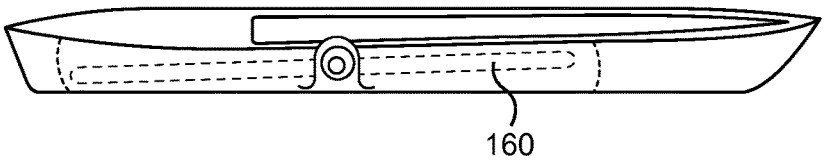
FIG. 7 is another pictorial side view of another embodiment of the present invention.

FIGS. 6 and 7 illustrates another embodiment of the present invention 10 whereby the member 20 is disposed in a channel 160 within the hull to allow the member 20 to pivot clockwise, or counter clockwise about a first axis 150.

Figure 8:
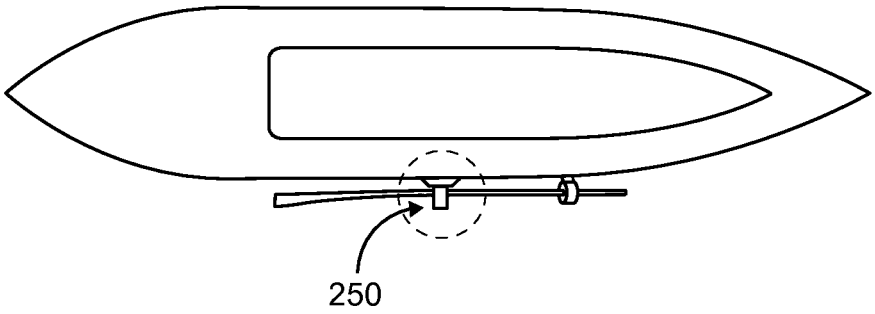
FIG. 8 is another embodiment of the present invention having a ball and socket joint.
Figure 8A:
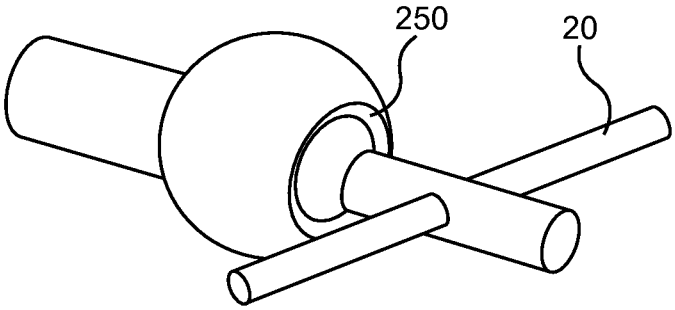
FIG. 8A is a view of the ball and socket joint of one embodiment of the present invention.

FIG. 8 illustrates one embodiment of the member pivoting means 50 whereby the member pivoting means 50 is a ball and socket joint 250 that can allow the member 20 to pivot in an array of directions.

Figure 9:
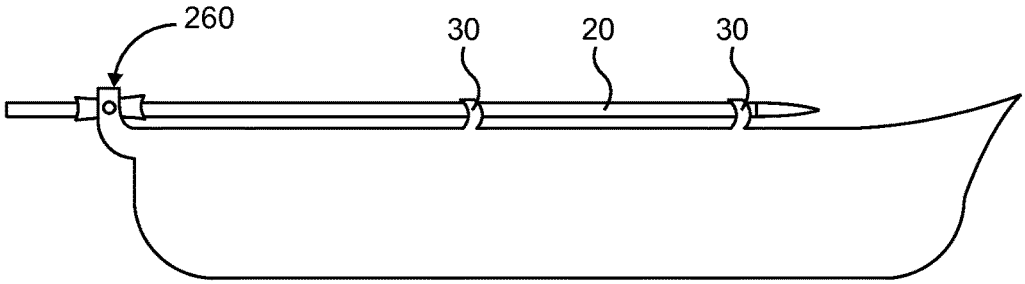
FIG. 9 is another pictorial embodiment of the present invention whereby the back-front pivoting means is on the front or rear of the boat.

FIG. 9 illustrates one embodiment of a back-front member pivoting means 260 can be disposed on either the back of the boat 280, or the front of the boat 280.

Figure 10:
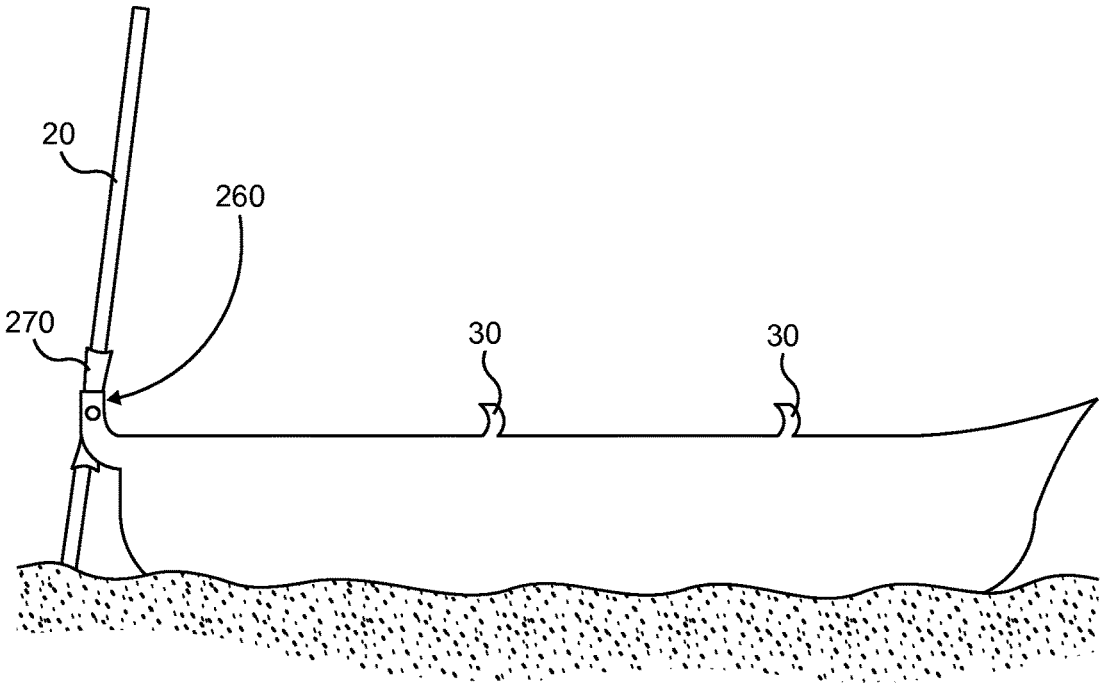
FIG. 10 is a pictorial of an embodiment of the present invention whereby the back-front pivoting means is on the front or rear of the boat.
Figure 11:
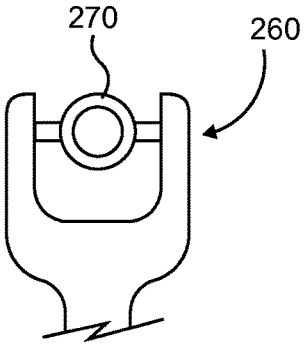
FIG. 11 is a top view of the back-front pivoting means.

FIGS. 10 and 11 illustrates the back-front pivoting means in either the front or back of the boat 280, rather than on its side, as in FIG. 5-8.

Figure 12:
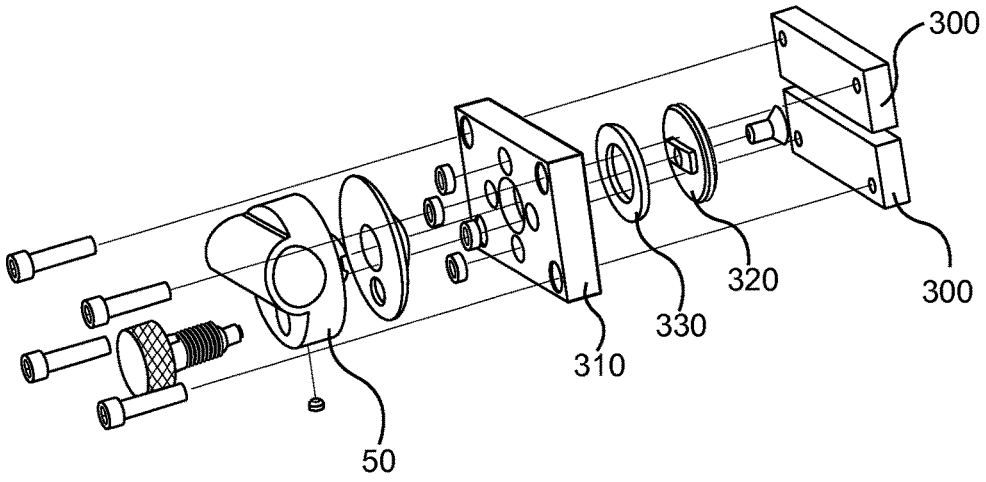
FIG. 12 is an exploded view of an embodiment of the pivoting means or the back-front pivoting means structure.

FIG. 12 illustrates one embodiment of the member pivoting means 50. The member pivoting means 50 may have a base 200 comprised of a backing plate 300, and a base swivel 310 disposed above the backing plate 300. A retainer swivel 320 may be rotatably between the backing plate 300 and the base swivel 310. A washer 330 may be disposed between the retainer swivel 320 and the base swivel 310, to allow the retainer swivel 320 to rotate with respect to the backing plate 300 and the base swivel 310. The member pivoting means 50 may then be secured to the retainer swivel 320, so that the member pivoting means 50 can rotate.

A delrin washer may be disposed between said 50 and said 310. A plurality of insert pins disposed between the delrin washer and the backing plate (310), whereby the insert pins keep the aluminum backing plate (310) from bending, and the insert pins receive said locking plunger to lock the swivel in place.

Figure 13:
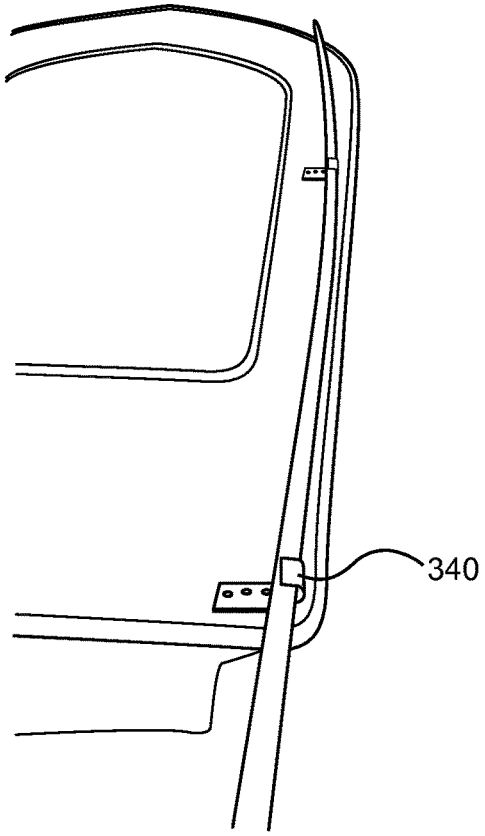
FIG. 13 is a pictorial showing the top member retention means.

FIG. 13 illustrates on embodiment of the member 20 being disposed on the top of the boat, and illustrating top member retention means 340.

Figure 14:
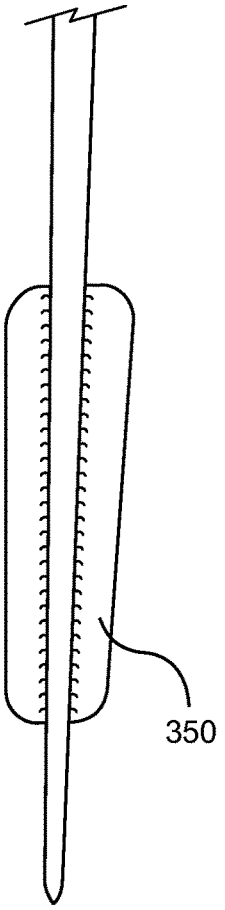
FIG. 14 is a pictorial showing a drift paddle of the present invention.

FIG. 14 illustrates a drift paddle 350 that may be used with the present invention.

In one embodiment the outside diameter of the member 20 may be ¾ of an inch, and the inside diameter of the member pivoting means 50 and back-front pivoting means 260 may be ¾ of an inch. In this respect, the member 20 may be able to be manually displaced and moved within the member pivoting means 50 or the back-front pivoting means 260. When the member 20 is then placed in the ground under the water, the displacement of the boat and water causes the member 20 to bind or bend with respect to the collar 190 of the pivoting means 50, 260, thus locking the member 20 to either pivoting means 50, 260, which keeps the boat stabilized with respect to the water. The boat 280 can no longer pivot because the pressure from the member 20 against the pivot member 50, 260 prevent the boat 280 from moving. This may also be accomplished by fixing the member 20 to the collar 190 by a clamping means.

Typically the user can rotate the member pivoting means 50 or the front-back pivoting means 260, and then lock that in place via the lock and lock release 60, then the member 20 can be positioned in the member pivoting means 50 or front-back pivoting means 260.

In another embodiment, the outside diameter of the member 20 may be slightly smaller than the inside diameter of the member pivoting means 50 and back-front pivoting means 260. In this respect, the member 20 may be able to be manually displaced and moved within the member pivoting means 50 or the back-front pivoting means 260. When the member 20 is then placed in the ground under the water, the displacement of the boat and water causes the member 20 to bind or bend with respect to the collar 190 of the pivoting means 50, 260, thus locking the member 20 to either pivoting means 50, 260, which keeps the boat stabilized with respect to the water. The boat 280 can no longer pivot because the pressure from the member 20 against the pivot member 50, 260 prevent the boat 280 from moving.

In another embodiment, the outside diameter of the member 20 may be about the same size, but not larger than the inside diameter of the member pivoting means 50 and back-front pivoting means 260. In this respect, the member 20 may be able to be manually displaced and moved within the member pivoting means 50 or the back-front pivoting means 260. When the member 20 is then placed in the ground under the water, the displacement of the boat and water causes the member 20 to bind or bend with respect to the collar of the pivoting means 50, 260, thus locking the member 20 to either pivoting means 50, 260, which keeps the boat stabilized with respect to the water. The boat 280 can no longer pivot because the pressure from the member 20 against the pivot member 50, 260 prevent the boat 280 from moving.

In one embodiment the member 20 may be made from aluminum. It may be solid.

In one embodiment both the member pivoting means 50 and the front-back pivoting means 260 may be aluminum. In one embodiment, both pivoting means 50, 260 may have a sleeve therein, which the member 20 is disposed, and the sleeve may be of a material that is not aluminum.

The anchoring, maneuvering, docking, and stabilizing apparatus of the present invention may be used for boat or vessel maneuvering, docking, or stabilizing the vessel.

The member 20 may be displaced manually, electrically, hydraulically, or pneumatically.

The member 20 can be mounted on the top, bottom, back, front, or inside the water vessel.

In use, the member 20 may be slidably disposed through the collar 190. Then the collar 190 or pivoting means 50, 260 can be rotated so that the member 20 can be slid downwardly into the water or the ground beneath the water's surface, then the pivoting means 50, 260 can be locked in place via the lock and lock release 60. After locking the pivoting means 50, 260 in place, the pivoting means 50, 260 is fixed in place. The member 20 will bind or bend due to the forces from the water and boat 280, and this binding effect prevents the boat from descending or going lower, and it also stabilizes the boat 280. The boat 280 when encountering a wave, may be forced upwardly by the wave because the buoyancy of the wave will release the forces that bind or bend the member 20, allowing the collar 190 to displace upwardly.

For example, the member 20 is disposed through the collar 190 on the right side of the vessel or boat 280, and the member 20 has been displaced into the ground or surface under the water. Then if the user were to step on the right side of the boat 280, the collar 190 on the right side of the boat 280 would displace downwardly, typically about its longitudinal center axis, and the collar 190 would be in locking engagement with the member 20. In this example, the left side of the vessel or boat would accordingly displace upwardly. This due to the bend of the member 20 that would be fixedly engaged with the inside diameter of the substantially straight, cylindrical collar 190.

After the member 20 is placed in the ground under the water, The force of gravity on the boat 280, and the forces in the water, would then cause the member 20 to bind or bend, creating the member 20 to be secured to the collar 190. Then, the boater can pull the member 20 upwardly to slide it away from the water, and place it in its stowed position as seen in FIGS. 8, 9, and 13.

Likewise, if the vessel or boat 280 rotates counterclockwise along its longitudinal axis while "looking" forward, and if the right side of the vessel or boat 280 is displaced upwardly and the left side displaced downwardly, the slight bend of the member 20 on the right side of the boat 280 will cause the member 20 to be in locking engagement with the collar 190 when the member 20 is secured in the ground or surface beneath the water.

Moreover, the member 20 when disposed in the ground beneath the water's surface can be used to dock the vessel 280.

It should be understood, of course, that the foregoing relates to exemplary embodiments of the invention and that modifications may be made without departing from the spirit and scope of the invention as set forth in the following claims.

I claim:

1. A stabilizing apparatus for use with a vessel, the stabilizing apparatus comprising:

a base having a point of rotation and including a base plate;

a pivoting collar member pivotally coupled to the base at the point of rotation and defining a stabilizing member channel therethrough, the pivoting collar member including a base swivel and a retainer swivel, the retainer swivel operably configured to rotate in between the base and the base swivel; and a stabilizing member including a ground contact portion, the stabilizing member sized to fit within the stabilizing member channel of the pivoting collar member such that the stabilizing member couples with the pivoting collar member in response to an outside force when the stabilizing member is coupled to a ground surface.

2. The stabilizing apparatus according to claim 1, further comprising:

a member retention means disposed a distance from the base for securing the stabilizing member in a stationary position.

3. The stabilizing apparatus according to claim 2, wherein:

the member retention means is an elastic member.

4. The stabilizing apparatus according to claim 1, wherein:

the stabilizing member includes an outside diameter that is at least one of equal to and less than an inside diameter of the stabilizing member channel defined by the pivoting collar member.

5. The stabilizing apparatus according to claim 1, wherein:

the ground contact portion of the stabilizing member is removably coupled to the stabilizing member.

6. The stabilizing apparatus according to claim 1, wherein:

the ground contact portion includes a ground penetration member having a spiral shape.

7. The stabilizing apparatus according to claim 1, wherein:

the stabilizing member is slidably coupled within the collar; and the stabilizing member is of a flexible material.

8. A stabilizing apparatus for use with a vessel, the stabilizing apparatus comprising:

a base having a point of rotation and including a base plate;

a pivoting collar member pivotally coupled to the base at the point of rotation and defining a stabilizing member channel therethrough, the pivoting collar member including a base swivel and a retainer swivel, the retainer swivel operably configured to rotate in between the base and the base swivel;

a stabilizing member:

having a first portion and a second portion separate by a length, the second portion including a ground penetration member; and sized and shaped to slidably couple within the stabilizing member channel defined by the pivoting collar member such that the stabilizing member couples to the pivoting collar member in response to an outside force when the ground penetration member is coupled to a ground surface; and a member retention means for retaining the first portion of the stabilizing member in a stationary position.

9. The stabilizing apparatus according to claim 8, wherein:

the base is configured to be oriented in a vertical position with respect to one of a right side and a left side of a vessel.

10. The stabilizing apparatus according to claim 8, wherein:

the stabilizing member includes an outside diameter that is at least one of equal to and less than an inside diameter of the stabilizing member channel defined by the pivoting collar member.

11. The stabilizing apparatus according to claim 8, wherein:

the ground penetration member is removably coupled to the second portion of the stabilizing member.

12. The stabilizing apparatus according to claim 8, wherein:

the ground penetration member includes a curved shape.

13. The stabilizing apparatus according to claim 8, wherein:

the member retention means includes an elastic member.

14. A method of stabilizing a vessel, the method comprising:

providing a stabilizing apparatus including:

a base having a point of rotation and including a base plate;

a pivoting collar member pivotally coupled to the base at the point of rotation and defining a stabilizing member channel therethrough, the pivoting collar member including a base swivel and a retainer swivel, the retainer swivel operably configured to rotate in between the base and the base swivel; and a stabilizing member including a ground contact portion, the stabilizing member sized to fit within the stabilizing member channel of the pivoting collar member such that the stabilizing member couples with the pivoting collar member in response to an outside force when the stabilizing member is coupled to a ground surface;

inserting the stabilizing member within the stabilizing member channel defined by the pivoting collar member;

pivoting the pivoting collar member; and inserting the ground penetration member of the stabilizing member within a ground surface.

15. The method according to claim 14, further comprising:

providing the ground contact portion of the stabilizing member having a spiral shape.

16. The method according to claim 14, further comprising:

providing the base including a member retention means for retaining the stabilizing member in a stationary horizontal position with respect to the ground surface;

pivoting the stabilizing member from a vertical position with respect to the ground surface to the stationary horizontal position with respect to the ground surface; and retaining the stabilizing member in the stationary horizontal position with respect to the ground surface using the member retention means.

* * * * *